US011338357B2

(12) United States Patent
Smith

(10) Patent No.: US 11,338,357 B2
(45) Date of Patent: May 24, 2022

(54) DIFFUSION ARTICLE

(71) Applicant: HarbisonWalker International, Inc., Moon Township, PA (US)

(72) Inventor: Mark Smith, Rocky River, OH (US)

(73) Assignee: HarbisonWalker International, Inc., Moon Township, PA (US)

( * ) Notice: Subject to any disclaimer, the term of this patent is extended or adjusted under 35 U.S.C. 154(b) by 249 days.

(21) Appl. No.: 16/544,020

(22) Filed: Aug. 19, 2019

(65) Prior Publication Data

US 2021/0053111 A1 Feb. 25, 2021

(51) Int. Cl.

| | |
|---|---|
| ***B22D 11/118*** | (2006.01) |
| ***B22D 41/00*** | (2006.01) |
| ***B22D 1/00*** | (2006.01) |
| ***B22D 11/119*** | (2006.01) |
| ***B22D 11/117*** | (2006.01) |

(52) U.S. Cl.
CPC ..... *B22D 11/119* (2013.01); *B22D 1/002* (2013.01); *B22D 11/117* (2013.01); *B22D 11/118* (2013.01); *B22D 41/00* (2013.01)

(58) Field of Classification Search
CPC ..... B22D 1/002; B22D 1/005; B22D 11/103; B22D 11/117; B22D 11/118; B22D 11/119; B22D 41/00; B22D 41/08
See application file for complete search history.

(56) References Cited

U.S. PATENT DOCUMENTS

| | | | | |
|---|---|---|---|---|
| 4,667,939 | A * | 5/1987 | Luyckx | C22B 9/055 266/287 |
| 5,004,495 | A | 4/1991 | Labate | |
| 5,064,175 | A | 11/1991 | Soofi | |
| 5,511,766 | A | 4/1996 | Vassilicos | |
| 5,551,672 | A * | 9/1996 | Schmidt | B22D 11/118 266/229 |
| 2021/0016346 | A1* | 1/2021 | Liu | B22D 43/00 |

FOREIGN PATENT DOCUMENTS

| | | | | |
|---|---|---|---|---|
| EP | 0312549 | A1 | 4/1989 | |
| EP | 0558018 | A1 | 9/1993 | |
| FR | 2642679 | A3 | 12/1988 | |
| FR | 2642679 | A3 | 8/1990 | |
| GB | 2164281 | A | 3/1986 | |
| JP | H08 117939 | A | 5/1996 | |
| JP | 2004098066 | | 4/2004 | |
| JP | 2005000957 | A * | 1/2005 | B22D 11/118 |

(Continued)

OTHER PUBLICATIONS

EPO machine translation of JP 2004-098066 A (Year: 2004).*

(Continued)

*Primary Examiner* — Kevin E Yoon
(74) *Attorney, Agent, or Firm* — Kusner & Jaffe

(57) ABSTRACT

A diffusion component for impregnating molten steel with a gas includes a barrier having a first side and a second side, a through-hole formed within the barrier, the through-hole connecting the first side to the second side, and a porous element arranged within the through-hole such that the flow of molten steel passes over the porous element. At least one flow disrupter is arranged relative to the porous element and configured to promote non-laminar flow of molten steel passing through the through-hole.

20 Claims, 2 Drawing Sheets

(56) References Cited

FOREIGN PATENT DOCUMENTS

| | | |
|---|---|---|
| RU | 2644095 C2 | 2/2018 |
| WO | WO 1988/04331 | 6/1988 |
| WO | WO 95/06534 A1 | 3/1995 |

OTHER PUBLICATIONS

EPO machine translation of FR 2642679 A3 (Year: 1990).*
International Search Report & Written Opinion dated Oct. 20, 2020 in related/corresponding PCT Appl. No. PCT/US20/45874, filed Aug. 12, 2020.
Cwudziński, A., "Hydrodynamic effects created by argon stirring liquid steel in a one-strand tundish," Ironmaking & Steelmaking, 45(6), pp. 528-536, 2018.

* cited by examiner

DIFFUSION ARTICLE

FIELD OF THE INVENTION

The present invention relates generally to metallurgy and, more particularly, to a method for removing contaminants in liquid steel through diffusion of a gas into the liquid steel, and to a diffusion apparatus for diffusing the gas into liquid steel.

BACKGROUND OF THE INVENTION

In a process for continuous casting of steel, an intermediate vessel called a "tundish" is used to transfer liquid steel from a steel teeming ladle to a mold. The tundish is a large, trough-like container that is lined with refractory material and is dimensioned to receive molten steel from the steel ladle. The tundish, which typically has sloping sidewalls that, when viewed in cross-section, have an inverted trapezoidal shape, has one or more holes with slide gates or stopper rods associated therewith for controlling the flow of the molten steel from the tundish. The tundish feeds liquid steel into copper molds of a continuous casting machine to give a smoother flow. In this respect, the tundish is an intermediate vessel that receives molten steel from steel ladles and smooths out flow and regulates steel fed to the mold.

Re-oxidation of liquid steel in the tundish readily occurs despite metallurgical and design efforts to minimize such re-oxidation. A consequence of such re-oxidation is the creation of non-metallic inclusions. These inclusions initiate and progressively propagate restrictive clogging of the flow passages and may generate inclusion flaws in continuously casted solidified steels.

A known method for the removal of the non-metallic inclusions is to purge the liquid steel with a stream of non-reactive gasses, such as Argon or Nitrogen. The inclusions in the steel attach to a gas bubble and float up to a slag layer that typically forms along the upper surface of the molten steel. The non-reactive gasses are introduced via purging bars located at the bottom of the tundish.

SUMMARY OF THE INVENTION

A vertical cross-section of a typical tundish is inverted convex trapezoid, with the bottom edge shorter than the top edge. The purging bars are located at the bottom of the tundish and thus do not affect the entire width of the liquid steel column. Since the gaseous bubbles float straight up from the purging bars and, due to the sloped sidewalls of the tundish, gaps are formed on the side of the tundish where the curtain of bubbles does not penetrate the liquid steel. As a result, at least some molten steel is not exposed to the gas. In addition, the purging bar provides only slim gas "curtain" that can be easily disrupted by the flowing steel. This steel movement further heterogenizes the effective presence of the gas bubbles.

A device and method in accordance with the present invention overcomes the above problem and provides improved exposure of the steel to the gas. In accordance with the present invention, provided is a diffusion component that includes a porous element located throughout an entire width of a bottom edge or bottom passageway of the diffusion component, and substantially all of the molten steel passes through the passageway. This eliminates blind spots and subjects substantially all of the liquid steel to gas. Additionally, a series of geometrical flow disruptors may be arranged in the diffusion component that promote non-laminar flow, which ensures good intermixing and homogenization of purging gases with the liquid steel.

According to one aspect of the invention, a diffusion component for exposing molten steel to a gas includes: a barrier having a first side and a second side; a through-hole formed in the barrier, the through-hole connecting the first side to the second side; a porous element arranged within the through-hole such that the flow of molten steel passes over the porous element; and at least one flow disrupter arranged in the through-hole and configured to create non-laminar flow of molten steel passing through the through-hole.

In one embodiment, the barrier comprises a first portion having a first wall thickness and a second portion having a second wall thickness, the second wall thickness being greater than the first wall thickness, and wherein the through-hole is formed in the second portion.

In one embodiment, the barrier comprises a third portion having a third wall thickness different from the first wall thickness, and the first portion is arranged between the second portion and the third portion.

In one embodiment, the third portion comprises a radiused section that transitions from a first surface to a second surface orthogonal to the first surface.

In one embodiment, the at least one flow disrupter is formed in a surface of the porous element.

In one embodiment, the at least one flow disrupter comprises a surface having surface irregularities.

In one embodiment, the at least one flow disrupter comprises a surface having a series of peaks and valleys.

In one embodiment, the at least one flow disrupter comprises a surface having at least one of an undulating contour or a sinusoidal contour.

In one embodiment, the porous element spans an entire width of the through-hole.

In one embodiment, the diffusion component includes a chamber arranged beneath the porous element, the chamber configured to receive a gas and communicate the received gas to the porous element to create a wall of bubbles within the through-hole.

In one embodiment, the diffusion component includes a conduit fluidically coupled to the porous element and extending to an exterior region of the diffusion component, the conduit operative to feed a gas to the porous element.

In one embodiment, the conduit is at least partially embedded within the barrier between the first side and the second side.

In one embodiment, an outlet of the through-hole is flared to decrease a velocity of molten steel exiting the through-hole relative to a velocity of molten steel entering the through-hole.

In one embodiment, the through-hole comprises an inlet arranged on the first side, an outlet arranged on the second side, and a passage coupling the inlet to the outlet, and a surface area of the outlet is larger than a surface area of the inlet.

In one embodiment, a cross-section of the passage tapers between the inlet and the outlet.

According to another aspect of the invention, a tundish includes: a floor; a plurality of walls attached to the floor to define an interior space; and the diffusion component as described herein arranged within the interior space, the diffusion component spanning between two walls of the plurality of walls to define a first sub-space and a second sub-space.

In one embodiment, the tundish includes a baffle arranged within the interior space, the baffle spanning between the two walls of the plurality of walls to define a third sub-space.

In one embodiment, the tundish includes a submerged entry nozzle arranged to receive molten steel having passed through the through-hole and to expel molten steel from the interior space.

In one embodiment, a cross-section of the through-hole is at least two times a cross-sectional area of the submerged entry nozzle.

According to another aspect of the invention, a method is provided for removing inclusions from molten steel within a tundish, the tundish including a barrier that divides a tundish volume into a first volume and a second volume. The method comprises: directing the molten steel through a tunnel formed in the barrier; emitting a wall of gas bubbles along an entire width of the tunnel, whereby inclusions within the molten steel attach to the gas bubbles and are carried to a surface region of the molten steel; and creating non-laminar flow of the molten steel as the molten steel flows through the tunnel, whereby the non-laminar flow causes intermixing of the gas with the molten steel.

In one embodiment, the method includes causing the gas bubbles to flow away from the barrier at along a surface of the molten steel.

In one embodiment, the method includes causing the flow of molten steel to decrease in velocity exiting the through-hole relative to a velocity of molten steel entering the through-hole.

An advantage of the invention is that substantially all of the liquid steel is exposed to gas.

Another advantage of the invention is that the induced turbulence of the steel flow assures effective attachment of the non-metallic inclusions to the gas bubbles and flotation of the inclusions into the protective upper layer of the steel.

Another advantage of the invention is that the diffusion component forms a baffle.

Yet another advantage of the invention is that a velocity of molten steel exiting the passageway decreases, thereby increasing exposure time of the molten steel to the gas and thus improving attachment of inclusions to the gas.

Another advantage of the invention is that flow of the gas (and thus inclusions attached to the gas) is diverted horizontally and/or downstream to enhance entrapment of the inclusions in the tundish cover.

Yet another advantage of the invention that it can eliminate the need for a separate gas supply conduit within the tundish lining.

These and other advantages will become apparent from the following description of a preferred embodiment taken together with the accompanying drawings and the appended claims.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DETAILED DESCRIPTION OF PREFERRED EMBODIMENT

Figure 1:
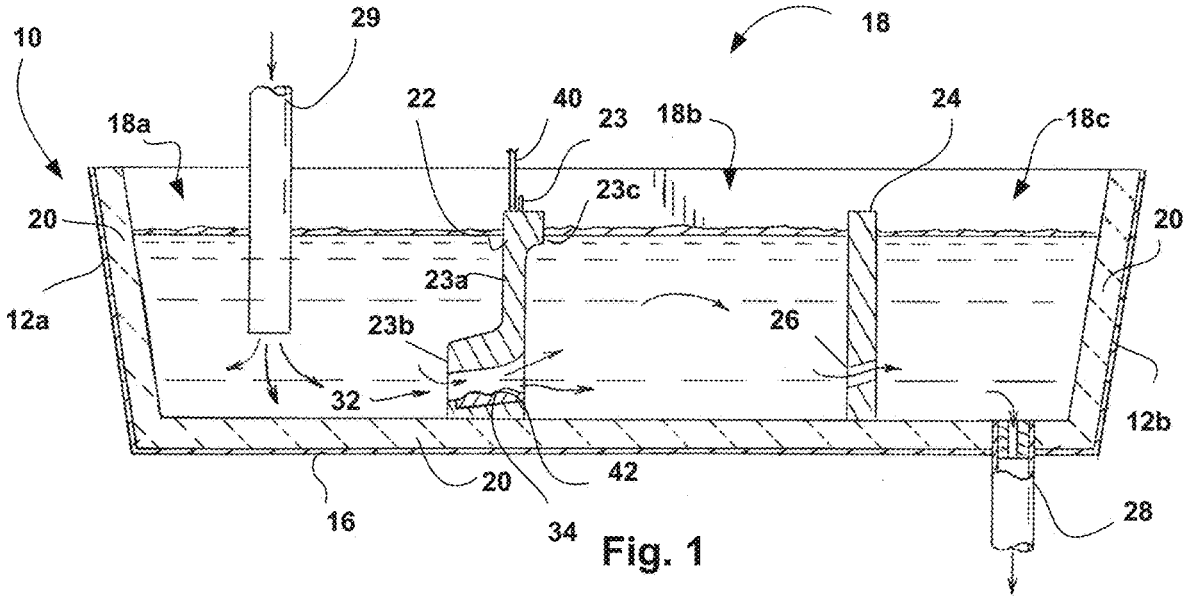
FIG. 1 is a side cross-sectional view of a diffusion component in accordance with an embodiment of the invention arranged within a tundish.

Referring now to the drawings wherein the showing is for illustrating a preferred embodiment of the invention only and not for limiting the same, the invention will be described with reference to the figures.

As discussed herein, re-oxidation of liquid steel in a tundish readily occurs and creates non-metallic inclusions. A device and method in accordance with the invention can enhance removal of such inclusions.

Figure 2:
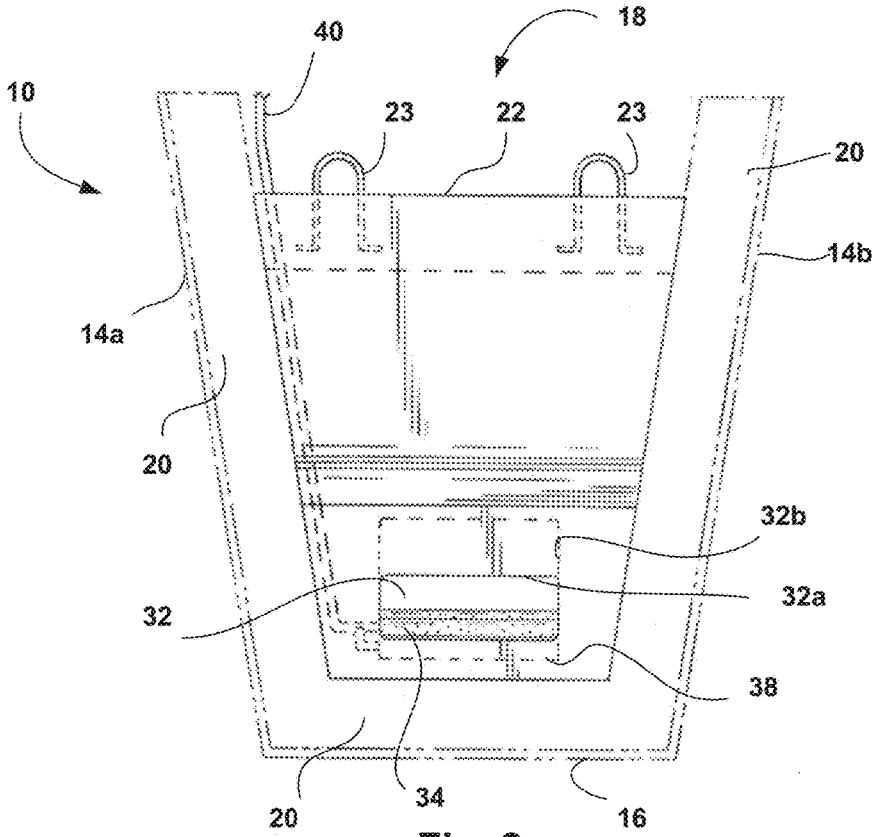
FIG. 2 is a front cross-sectional view of diffusion component in accordance with an embodiment of the invention arranged within a tundish.

Referring initially to FIGS. 1 and 2, illustrated is a tundish 10 that includes a plurality of sidewalls 12*a*, 12*b*, 14*a*, 14*b* each connected to a bottom wall 16 to define an interior space 18. As shown in the exemplary embodiment, the sidewalls may be angled relative to each other to define trough, although other configurations are possible. A refractory material 20 is arranged adjacent each side and bottom wall to insulate the walls from molten steel within the tundish 10.

Arranged within the interior space 18 is a diffusion component 22 in accordance with the present invention. The diffusion component 22 may include and/or be formed of refractory materials to enable the diffusion component to withstand the temperatures encountered with molten steel. As can be best seen in FIG. 2, the diffusion component 22 spans between walls 14*a* and 14*b*, which divides the interior space of the tundish 10 into a first sub-space 18*a* and a second sub-space 18*b*. Lifting means, such as clasps 23, provide a means for installing and removing the diffusion component 22 from the tundish 10. As will be described in further detail below, the diffusion component 22 exposes the molten steel to gas that attaches to inclusions in the steel, whereby the gas then carries the inclusions to an upper layer of the molten steel.

A baffle 24 is also arranged within the interior space 18 of the tundish 10 and spans between walls 14*a* and 14*b* to define a third sub-space 18*c*, the baffle including a tunnel 26 that enables transfer of molten steel between the second and third sub-spaces. While three sub-spaces 18*a*, 18*b*, 18*c* are illustrated, more or fewer sub-spaces may be utilized depending on the specific application requirements. A submerged entry nozzle 28 is arranged in a bottom portion of the third sub-space 18*c* for removal of molten steel from the tundish 10 for further processing In operation, molten steel from a ladle (not shown) enters the first sub-space 18*a* of the tundish 10 via a ladle shroud 29 and fills the first subspace 18*a*. The steel flows from the first sub-space 18*a* to the second sub-space 18*b* via a through-hole 32 formed in the diffusion component 22. As the molten steel flows through the through-hole 32, an inert gas, such as argon or nitrogen, is emitted from a porous element 34 arranged in a bottom portion of the through-hole 32. A wall of bubbles is formed in the through-hole 32, and all of the molten steel passes through this wall of bubbles, thus eliminating blind spots. The inclusions 30 (FIGS. 3 and 4) in the molten steel attach to gas bubbles 31 and are carried to an upper layer 33 of the molten steel, thereby facilitating removal of the inclusions 30 from the molten steel. The molten steel then flows from the second sub-space 18*b* to the third sub-space 18*c* via the tunnel 26 within the baffle 24.

Since the tunnel 26 is arranged below the upper layer of molten steel, the inclusions 30 are trapped in the second sub-space 18*b*. The "filtered" molten steel in the third sub-space 18*c* exits the tundish 10 through the submerged entry nozzle 28 for further processing.

Figure 3:
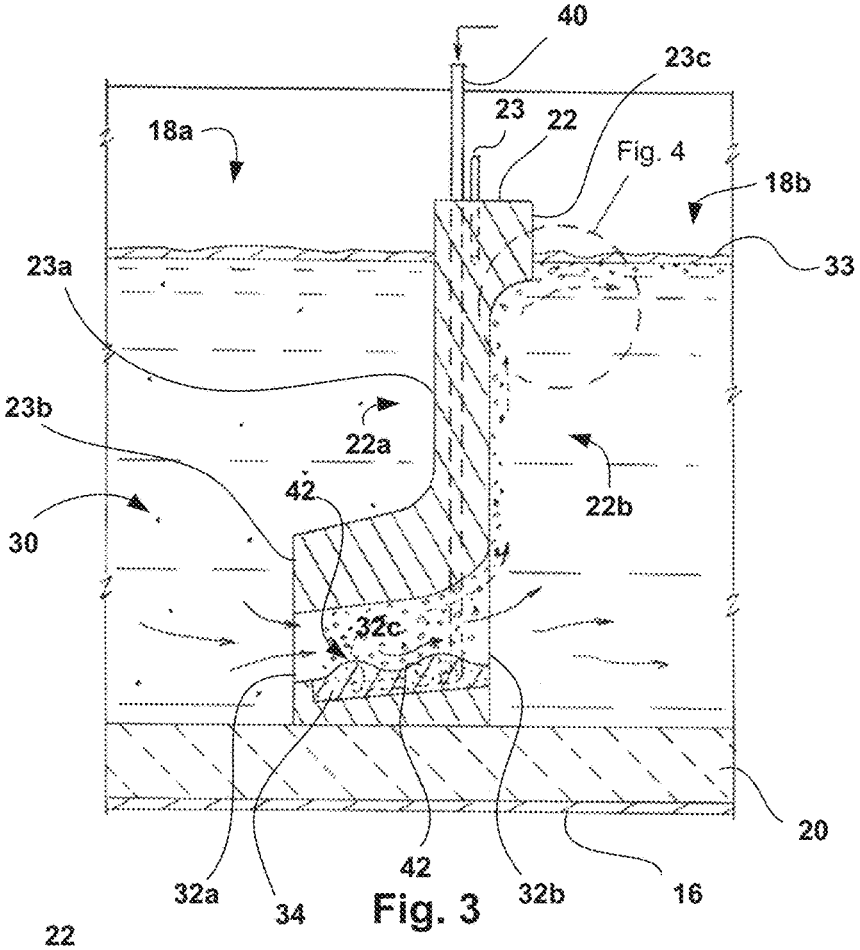
FIG. 3 is a detailed view of the diffusion component in accordance with an embodiment of the invention.
Figure 4:
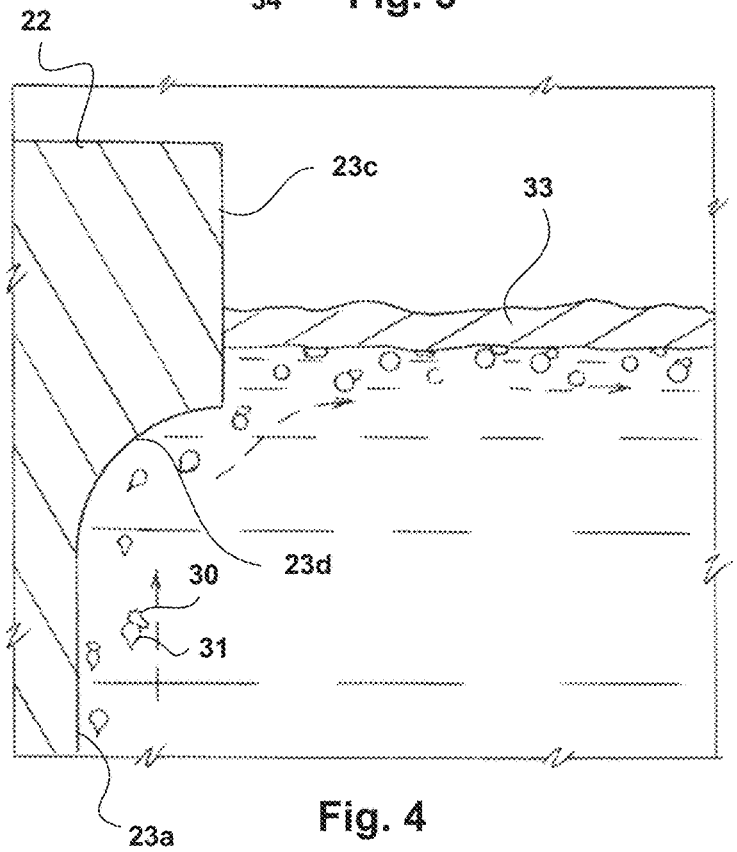
FIG. 4 is an enlarged view of a lip portion of the diffusion component in accordance with an embodiment of the invention.

With additional reference to FIG. 3, the exemplary diffusion component 22 is shown in more detail. The diffusion component 22 is formed as a barrier that is dimensioned to fit within the tundish 10 from one sidewall to another sidewall. The diffusion component 22 includes a first side 22*a* and a second side 22*b*, where the through-hole 32 connects the first side 22*a* to the second side 22*b*, e.g., the through-hole forms a tunnel. In one embodiment, a cross-sectional area of the through-hole 36 is at least two times a cross-sectional area of the submerged entry nozzle 28. This size relationship ensures that a flow capacity of the through-hole 32 meets or exceeds a flow capacity of the submerged entry nozzle 28.

In one embodiment, the diffusion component 22 includes a first portion 23*a* having a first wall thickness, a second portion 23*b* having a second wall thickness (the portion in which the through-hole 32 is formed), and a third portion 23*c* having a third wall thickness, where the second wall thickness and the third wall thickness are each greater than the first wall thickness. The third portion 23*c* may include a radiused section 23*d* that transitions from a first direction to a second direction that is generally orthogonal to the first direction. An advantage of such transition is that the inclusions 30 are directed away from the diffusion component 22 and along an upper surface of the molten steel.

The through-hole 32 may take various shapes. For example, in one embodiment a cross section of the passage 32*c* between an inlet 32*a* of the through-hole 32 and an outlet 32*b* of the through-hole 32 tapers linearly, becoming larger at the outlet 32*b* relative to the inlet 32*a* (e.g., the passage 32*c* connecting the inlet to the outlet is tapered such that a surface area at the outlet 32*b* is larger than a surface area at the inlet 32*a*). In another embodiment, the outlet 32*b* of the through-hole 32 is flared, e.g., the region of the passage 32*c* just before the outlet 32*b* exponentially increases in size. The tapered and flared features of the through-hole 32 have the effect of decreasing a velocity of molten steel as it exits the outlet 32*b* relative to a velocity of molten steel entering the inlet 32*a*. This slowing down of the flow can prolong the time the molten steel is exposed to the gas and thus promote attachment of inclusions 30 to the gas 31.

The porous element 34 is arranged along a bottom portion of the through-hole 32 such that the flow of molten steel passes over the porous element 34. The porous element may be formed from alumina, alumina-silicate, alumina-chromia, or magnesia based permeable refractory. The permeability could be organized randomly or directionally.

The porous element 34 may correspond to a shape of the through-hole 32. For example, if the through-hole is rectangular, the porous element may be in the form of a rectangular element having a width that spans the entire width of the through-hole 32. This ensures that no blind spots exist within the through-hole and that all of the molten steel passing through the through-hole is exposed to the gas. The length of the porous element 34 can span at least a portion of the length of the through-hole 32. In one embodiment, the length of the porous 34 element is the same as the length of the through-hole 32 (e.g., from the input to the output of the through-hole). In another embodiment, the length of the porous element is less than a length of the through-hole.

A chamber 38 may be arranged beneath the porous element 34 and configured to receive an inert gas via a conduit 40, the conduit extending to an exterior region of the diffusion component 22. The conduit 40 may be at least partially embedded within the diffusion component between the first side 22*a* and the second side 22*b*. The chamber 38 evenly provides the received gas to the porous element 34, which creates a wall of bubbles within the through-hole 32.

To ensure all molten steel passes through the gas emitted from the porous element 34, the porous element 34 spans an entire width of the through-hole 32. In one embodiment, the through-hole 32 has a generally rectangular shape. However, other shapes are possible, such as an oval or circular shape, so long as the porous element 34 is configured to create a wall of gas through which substantially all of the molten steel passes as it moves from the first side 22*a* to the second side 22*b* of the diffusion element 22. The porous element 34 may span the entire length of the through-hole 32. For example, the porous element may begin at the inlet 32*a* and span through the passage 32*c* to the outlet 32*b*. Alternatively, the porous element 34 may span a portion that is less than an entire length of the through-hole 34. However, the porous element should be of sufficient length to create a wall of gas bubbles within the through-hole 32. For example, the porous element 34 may be approximately 12-14 inches in length.

Arranged relative to the porous element 34 is at least one flow disrupter 42, which is configured to promote non-laminar flow of molten steel passing through the through-hole 32. The one or more flow disrupters 42 may take on various configurations. For example, the flow disrupters 42 may be formed in a surface of the porous element 34 as surface irregularity, e.g., a sharp change in the surface contour of the porous element 34. Alternatively or additionally, the flow disrupters 42 may be formed in at least one of a surface of the porous element, a bottom wall, sidewall or top wall of the through-hole 32, and/or may be positioned parallel or perpendicular to the flow of molten steel. Each flow disrupter may include one or more surfaces having a series of peaks and valleys. The peaks and valleys may form a surface contour that is undulating and/or sinusoidal. As the molten steel passes through the through-hole 32, the flow disrupters 42 create turbulence that promotes better intermixing of the steel and the gas, thus promoting better attachment of the inclusions 30 with the gas bubbles 31.

The present invention thus provides more a uniform mixing and interacting of the gas with the molten steel, thereby facilitating better removal of inclusions from the molten steel.

The foregoing description is a specific embodiment of the present invention. It should be appreciated that this embodiment is described for purposes of illustration only, and that numerous alterations and modifications may be practiced by those skilled in the art without departing from the spirit and scope of the invention. It is intended that all such modifications and alterations be included insofar as they come within the scope of the invention as claimed or the equivalents thereof.

Having described the invention, the following is claimed:

1. A diffusion component for exposing molten steel to a gas, comprising:

a barrier having a first side and a second side;

a through-hole formed in the barrier, the through-hole connecting the first side to the second side, wherein an outlet of the through-hole is flared to decrease a velocity of molten steel exiting the through-hole relative to a velocity of molten steel entering the through-hole;

a porous element arranged within the through-hole such that the flow of molten steel passes over the porous element; and at least one flow disrupter arranged in the through-hole and configured to create non-laminar flow of molten steel passing through the through-hole.

2. The diffusion component according to claim 1, wherein the barrier comprises a first portion having a first wall thickness and a second portion having a second wall thickness, the second wall thickness being greater than the first wall thickness, and wherein the through-hole is formed in the second portion.

3. The diffusion component according to claim 2, wherein the barrier comprises a third portion having a third wall thickness different from the first wall thickness, and the first portion is arranged between the second portion and the third portion.

4. The diffusion component according to claim 3, wherein the third portion comprises a radiused section that transitions from a first surface to a second surface orthogonal to the first surface.

5. The diffusion component according to claim 1, wherein the at least one flow disrupter is formed in a surface of the porous element.

6. The diffusion component according to claim 1, wherein the at least one flow disrupter comprises a surface having surface irregularities.

7. The diffusion component according to claim 1, wherein the at least one flow disrupter comprises a surface having a series of peaks and valleys.

8. The diffusion component according to claim 1, wherein the at least one flow disrupter comprises a surface having at least one of an undulating contour or a sinusoidal contour.

9. The diffusion component according to claim 1, wherein the porous element spans an entire width of the through-hole.

10. The diffusion component according to claim 1, further comprising a chamber arranged beneath the porous element, the chamber configured to receive a gas and communicate the received gas to the porous element to create a wall of bubbles within the through-hole.

11. The diffusion component according to claim 1, further comprising a conduit fluidically coupled to the porous element and extending to an exterior region of the diffusion component, the conduit operative to feed a gas to the porous element.

12. The diffusion component according to claim 11, wherein the conduit is at least partially embedded within the barrier between the first side and the second side.

13. The diffusion component according to claim 1, wherein the through-hole comprises an inlet arranged on the first side, an outlet arranged on the second side, and a passage coupling the inlet to the outlet, and a surface area of the outlet is larger than a surface area of the inlet.

14. The diffusion component according to claim 13, wherein a cross-section of the passage tapers between the inlet and the outlet.

15. The diffusion component according to claim 1, wherein the porous element defines one surface of the through-hole.

16. The diffusion component according to claim 1, wherein the at least one flow disrupter defines one surface of the through-hole.

17. A tundish, comprising:

a floor;

a plurality of walls attached to the floor to define an interior space;

the diffusion component according to claim 1 arranged within the interior space, the diffusion component spanning between two walls of the plurality of walls to define a first sub-space and a second sub-space.

18. The tundish according to claim 17, further comprising a baffle arranged within the interior space, the baffle spanning between the two walls of the plurality of walls to define a third sub-space.

19. The tundish according to claim 17, further comprising a submerged entry nozzle arranged to receive molten steel having passed through the through-hole and to expel molten steel from the interior space.

20. The tundish according to claim 17, wherein a cross-section of the through-hole is at least two times a cross-sectional area of the submerged entry nozzle.

* * * * *